US010027038B2

(12) United States Patent
Otsu

(10) Patent No.: US 10,027,038 B2
(45) Date of Patent: Jul. 17, 2018

(54) PRESSURE CONTACTING CONNECTION TYPE CONTACT AND COAXIAL CONNECTOR USING THE SAME

(71) Applicant: J.S.T. Mfg. Co., Ltd., Osaka-shi (JP)

(72) Inventor: Akihiko Otsu, Yokohama (JP)

(73) Assignee: J.S.T. MFG. CO., LTD., Osaka-shi (JP)

( * ) Notice: Subject to any disclaimer, the term of this patent is extended or adjusted under 35 U.S.C. 154(b) by 0 days.

(21) Appl. No.: 15/819,536

(22) Filed: Nov. 21, 2017

(65) Prior Publication Data

US 2018/0145427 A1 May 24, 2018

(30) Foreign Application Priority Data

Nov. 24, 2016 (JP) ..... 2016-227496

(51) Int. Cl.

| | |
|---|---|
| ***H01R 4/48*** | (2006.01) |
| ***H01R 9/05*** | (2006.01) |
| ***H01R 13/24*** | (2006.01) |
| ***H01R 24/40*** | (2011.01) |
| *H01R 103/00* | (2006.01) |

(52) U.S. Cl.

CPC ..... *H01R 4/48* (2013.01); *H01R 9/0518* (2013.01); *H01R 13/2435* (2013.01); *H01R 24/40* (2013.01); *H01R 2103/00* (2013.01)

(58) Field of Classification Search

CPC ..... H01R 24/58; H01R 13/53; H01R 17/12; H01R 9/0518

USPC ..... 439/669, 668, 934, 578, 585

See application file for complete search history.

(56) References Cited

U.S. PATENT DOCUMENTS

| | | | | |
|---|---|---|---|---|
| 6,790,082 | B2 | 9/2004 | Obayashi | |
| 7,497,715 | B2 * | 3/2009 | Wu | H01R 12/57 439/329 |
| 9,331,408 | B2 * | 5/2016 | Ono | H01R 12/728 |
| 9,793,623 | B2 * | 10/2017 | Chen | H01R 9/0518 |
| 2002/0187660 | A1 | 12/2002 | Obayashi | |

FOREIGN PATENT DOCUMENTS

| | | | |
|---|---|---|---|
| JP | 2002-324636 | A | 11/2002 |
| JP | 2008-147094 | A | 6/2008 |

* cited by examiner

*Primary Examiner* — Phuong Chi T Nguyen
(74) *Attorney, Agent, or Firm* — Kratz, Quintos & Hanson, LLP

(57) ABSTRACT

The pressure contacting connection type contact has a base portion, a connecting terminal for a mating side contact, and a pressure contacting terminal. The pressure contacting terminal is provided with a base end section opposing an other end side of the base portion, where an extending piece extending from second both side portions of an other side of the base portion is folded such that mutual piece thickness faces are opposed, and a pair of pressure contacting pieces having spring characteristics where, from the base end section, the extending piece extends away from the base portion to the tip portion side such that the piece thickness faces are opposed, and in addition rises obliquely at an opposite side of the protrusion direction connecting terminal, and an open angle portion of the tip side of the pressure contacting pieces in which the central conductor can be inserted from an outer direction.

6 Claims, 14 Drawing Sheets

PRESSURE CONTACTING CONNECTION TYPE CONTACT AND COAXIAL CONNECTOR USING THE SAME

This application is based on and claims the benefit of priority from Japanese Patent Applications No, 2016-227496,filed on 24 Nov. 2016, the content of which is incorporated herein by reference.

BACKGROUND OF THE INVENTION

Field of the Invention

The present invention relates to a pressure contacting connection type contact, and to a coaxial connector. In particular, the present invention relates to a structure of a pressure contacting connection type contact having at a terminal portion a pressure contacting terminal which can pressure contacting connect with a central conductor of a coaxial cable, and to a structure of a coaxial connector equipped with this pressure contacting connection type contact.

Related Art

A coaxial connector fixed at a terminal of a coaxial cable, by being connected to a receptacle implemented at a printed circuit board, can transmit high frequency signals from the coaxial cable to the printed circuit board, or can transmit high frequency signals from the printed circuit board to the coaxial cable.

Generally, a coaxial cable is constituted of a circular central conductor, an insulator of a fluorine-based resin or the like surrounding the circumference of the central conductor, an external conductor of a braided wire or the like surrounding the circumference of the insulator, and an insulating sheath covering and protecting the external conductor.

For example, a coaxial connector according to the prior art is provided with metallic shell and cylindrical-shaped external contact. Further, the coaxial connector is provided with a housing and a central contact. The shell, at one end side thereof, is fixed to the insulating sheath of the coaxial cable by crimping. The shell and the external contact are constituted as one body. The external contact is formed at one end side of the shell, and is electrically connected to the external conductor of the coaxial cable.

The housing is electrically insulated from the external contact and the central contact. The central contact is disposed at the inner portion of the external contact. The central contact is provided with a pair of leaf spring pieces with a bifurcated constitution. By fitting the central conductor of the coaxial cable between the pair of leaf spring pieces, the pair of leaf spring pieces sandwich the central conductor, and therefore, the central conductor and the central contact can be electrically connected.

When the coaxial connector is connected to the receptacle, the external conductor can be connected to the external contact, and the central conductor can be connected to the central contact. Thus, it is possible to transmit high frequency signals from the coaxial cable to the printed circuit board, and to transmit high frequency signals from the printed circuit board to the coaxial cable.

Incidentally, in the coaxial connector according to the prior art, the central conductor of the coaxial cable was sandwiched only by the pair of leaf spring pieces, and therefore, there was the deficiency that the connection of the central conductor of the coaxial cable and the central contact was not reliable. Thus, for example, Japanese Unexamined Patent Application, First Publication No. 2002-324636 (below referred to as Patent Document 1), discloses a coaxial connector with a more reliable connection of the central conductor of the coaxial cable and the central contact.

On the other hand, the coaxial connector according to Patent Document 1 is constituted such that the central conductor of the coaxial cable is inserted between a pair of strip shaped contacting pieces opened in a V-shape, and the central conductor and the central contact are connected by one contacting piece pressing to the other contacting piece. However, there is the concern that if the axis of the central conductor with the contacting piece shifts, the high frequency characteristics will become unstable.

To deal with such a problem, for example, Japanese Unexamined Patent Application, First Publication No. 2008-147094 (below referred to as Patent Document 2) discloses a coaxial connector having a central contact which can be pressure contacting connect to the central conductor in a state such that the axis of the central conductor does not shift. Such a coaxial connector, in a central contact having a connecting terminal of a mating side contact at a base portion, is provided with a pair of oblique pieces obliquely rising from both side portions of a portion extending in a strip shape of the base portion, at an opposite side of the connecting terminal The central conductor of the coaxial cable is disposed between the pair of inclined pieces, namely, at the base portion including the portion extending in a strip shape at the base portion. Further, a pressing piece presses the central conductor to the base portion side in response to a folding of the shell, contributing to a reliable connection of the central conductor and the central contact. Further, the pressing face of pressing piece which presses the central conductor is concavely curved, and the pressing piece and the inclined piece opposing the pressing piece act so as to guide the central conductor to a precise location, namely to the central portion of the base portion.

The coaxial connector of Patent Document 2 has an effect of drawing the central conductor of the coaxial cable towards the central portion of the base portion of the central contact. However, the coaxial connector according to Patent Document 2has a form which continuously presses the central conductor of the coaxial cable towards the base portion of the central contact, and therefore, as time elapses, warping of the base portion and the pressing piece will increase, and there is concern that the so-called creep phenomenon will occur.

To avoid the occurrence of the creep phenomenon, there is demand for a pressure contacting connection type contact which can connect with central conductor of a coaxial cable and which has durability, and a coaxial connector provided with this pressure contacting connection type contact. Thus, the above can be said to be the problem to be solved by the present invention.

The present invention was made in consideration of such a problem, and has the objective of providing a pressure contacting connection type contact having durability and a coaxial connector provided with this pressure contacting connection type contact.

SUMMARY OF THE INVENTION

The present inventors discovered a pressure contacting terminal having a pressure contacting terminal where an extending piece extending from both sides of one portion of a strip shaped base portion is folded such that mutual piece thickness faces are opposed to form a base end section opposing the base portion, and having a pair of pressure contacting pieces extending from, the base end section with opposed piece thickness faces. The pair of pressure contacting pieces, in addition inclining away from the base portion towards the tip portion side to exhibit spring characteristics, are provided with an open angle portion where the tip portions are opened for connecting with the central conductor. The present inventors, who considered that for a pressure contacting connection type contact provided with such a pressure contacting terminal, a pair of pressure contacting pieces which have elasticity or spring characteristics can hold the central conductor in a state where the central conductor is inserted between the pair of pressure contacting pieces or into the open angle portion, and based on this, arrived at the invention of the novel pressure contacting connection type contact as described below, and the coaxial connector provided with this pressure contacting connection type contact.

The first aspect of the present invention is pressure contacting connection type contact for electrically connecting a coaxial cable and a mating side contact, comprising a connecting terminal having a base portion formed with a strip shape, and a pair of contacting pieces with a tip portion side opened in an Ω shape, inside which the mating side contact can be inserted, curvilinearly extending in a vertical direction from first both side portions of one end side of the base portion, and a pressure contacting terminal which pressure contacts a central conductor of the coaxial cable, at an other end side of the base portion, wherein the pressure contacting terminal comprises a base end section opposing an other end side of the base portion, where an extending piece extending from second both side portions of the other end side of the base portion is folded such that mutual piece thickness faces are opposed, and, a pair of pressure contacting pieces wherein, from the base end section, the extending piece extends away from the base portion to a tip portion side such that the piece thickness faces are opposed, and also rises obliquely at an opposite side of a protrusion direction of the pair of contacting pieces, and an open angle portion of the opposed piece thickness faces of the extending piece, formed at the tip portion sides of the pair of pressure contacting pieces, into which the central conductor of the coaxial cable can be inserted from, an outer direction.

According to the second aspect of the present invention, the base end section of the pressure contacting terminal preferably has a close contact bent portion which is bent to closely contact the base portion from the second both side portions, in a same direction as the protrusion direction of the pair of contacting pieces.

According to the third aspect of the present invention, the open angle portion of the pair of pressure contacting pieces preferably has a chamfered portion where tips portion sides of the opposed piece thickness faces are chamfered in an arc shape.

The coaxial connector according to the fourth aspect of the present invention constitutes a terminal of a coaxial cable having a central connector, an insulator surrounding this central conductor, an external conductor covering this insulator, and an insulating sheath covering this external conductor, comprising the pressure contacting connection type contact according to any one of the first to third aspects, a compound housing having a disk-shaped accommodating portion with one face opened such that a mating side contact is insertable, and having a first accommodating chamber wherein the connecting terminal is disposed, and a rectangular-shaped accommodating portion protruding from one portion of an outer periphery of the disk-shaped accommodating portion, and having a second accommodating chamber one part of which communicates with the first accommodating chamber, and which in addition can accommodate the pressure contacting connection type contact inserted from a protrusion direction of the connecting terminal at an other face, and having a groove portion communicating with the second accommodating chamber where the rectangular-shaped accommodating portion accommodates the pressure contacting pieces of the pressure contacting connection type contact, and a conductive shell having a cylindrical-shaped shell portion which is capable of accommodating the disk-shaped accommodating portion from a same direction as a direction of protrusion of the connecting-terminal, towards one face, and a pair of extended pieces extending in an approximately parallel direction continuously from one part of the outer periphery of the cylindrical-shaped shell portion, wherein the rectangular-shaped accommodating portion can be accommodated.

In the fifth aspect of the present invention, the housing preferably comprises a strip shaped lid housing with one end side bendably joined with one portion of the disk-shaped accommodating portion, and an other end side being able to open and close the second accommodating chamber and the groove portion, and the shell comprises a cable clamp having a base plate piece with one end side bendably joined with one portion of the cylindrical-shaped shell portion, and an other end side which interlocks with the lid housing, and which can open and close an other face of the shell.

In the sixth aspect of the present invention, the cable clamp preferably comprises a pair of conductor barrels which can crimp the external conductor, a pair of insulation grips which can crimp the insulating sheath, and a pair of crimp barrels which can crimp the rectangular-shaped accommodating portion via the pair of extended pieces.

BRIEF DESCRIPTION OF THE DRAWINGS

FIG. 3A is a plan view, FIG. 3B is a front face view, FIG. 3C is a right side face view, FIG. 3D is a back face view, and FIG. 3E is a lower face view.

FIG. 5A shows a state before the central conductor is inserted at the tip portion side of the pair of pressure contacting pieces.

FIG. 9A is a plan view, FIG. 9B is a front face view, FIG. 9C is a right side face view, FIG. 9D is a back face view, and FIG. 9E is a lower face view.

FIG. 12A is a plan view, FIG. 12B is a front face view, FIG. 12C is a right side face view, FIG. 12D is a back face view, and FIG. 12E is a lower face view.

FIG. 14A is a plan view, FIG. 14B is a front face view, FIG. 14C is a right side face view, FIG. 14D is a back face view, and FIG. 14E is a lower face view.

FIG. 15A shows a state viewed from a front direction of a state wherein the cable clamp provided at the coaxial connector is folded, and FIG. 15B shows a state viewed from a rear direction of the state wherein the cable clamp provided at the coaxial connector is folded.

DETAILED DESCRIPTION OF THE INVENTION

Below, embodiments of the invention are explained with reference to the drawings.

Constitution of the Pressure Contacting Connection Type Contact

First, the constitution of the pressure contacting connection type contact according to one embodiment of the present invention is explained.

Figure 1:
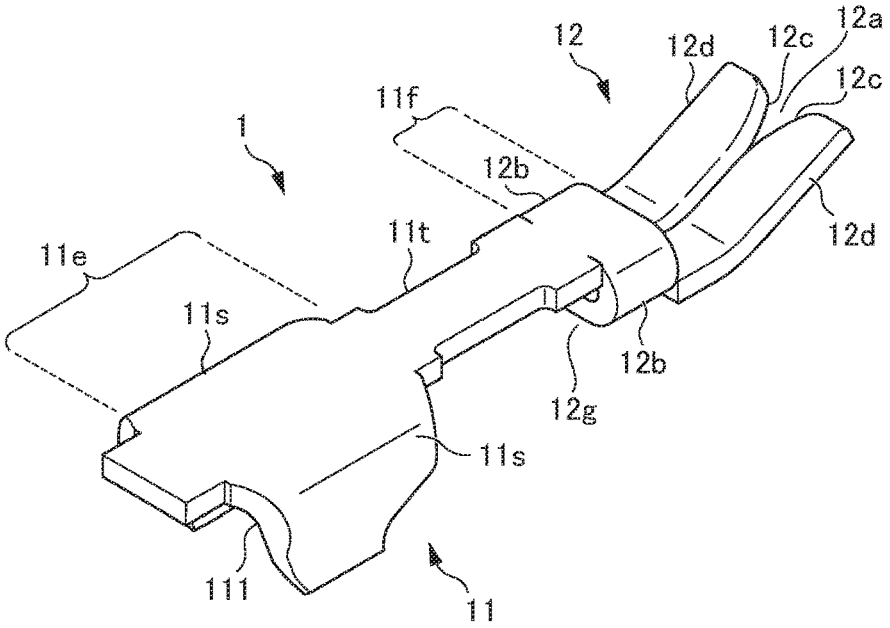
FIG. 1 is an oblique view snowing a constitution of as pressure contacting connection type contact according to one embodiment of the present invention, and shows a state viewed from the front side of the pressure contacting connection type contact.

FIG. 1 is an oblique view snowing the constitution of the pressure contacting connection type contact according to one embodiment of the present invention, and shows a state viewed from the front face of the pressure contacting connection type contact.

Figure 2:
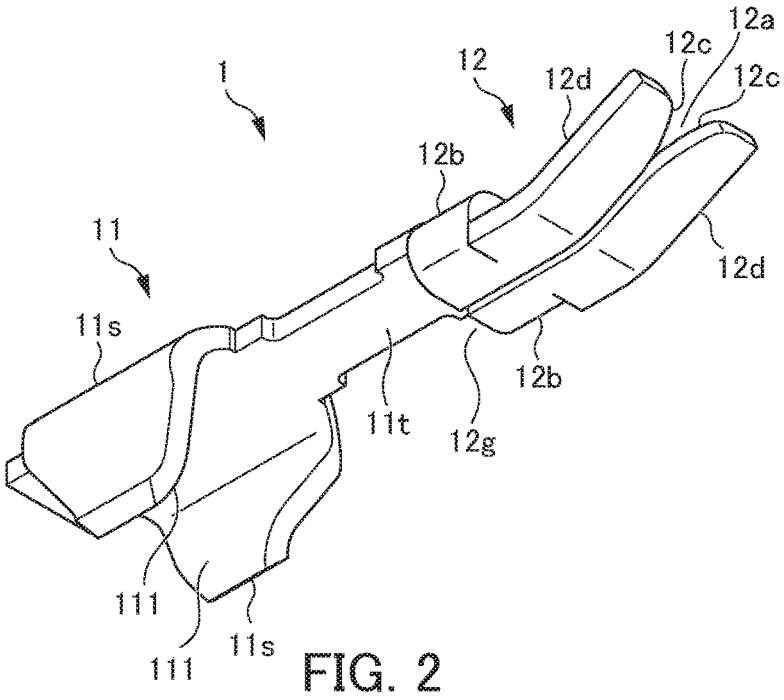
FIG. 2 is an oblique view showing the constitution of the pressure contacting connection type contact according to this embodiment, and shows a state viewed from a lower face side of the pressure contacting connection type contact.

FIG. 2 is an oblique view showing the constitution of the pressure contacting connection type contact of this embodiment, and shows a state viewed from a lower face side of the pressure contacting connection type contact.

Figure 3D:
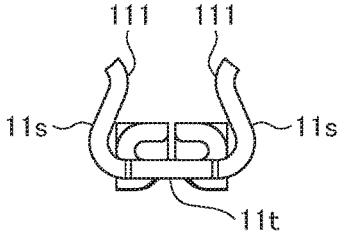
FIG. 3A to FIG. 3E are each views showing the constitution of the pressure contacting connection type contact according to the embodiment.
Figure 3E:
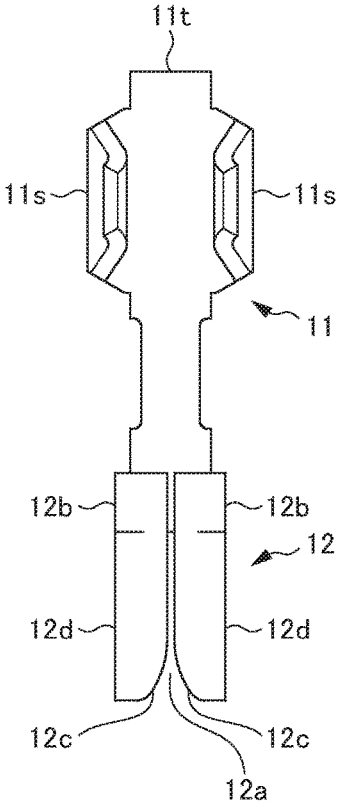
Figure 3A:
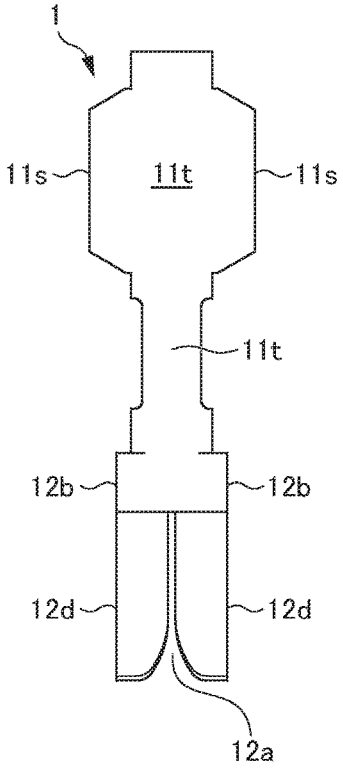
Figure 3C:
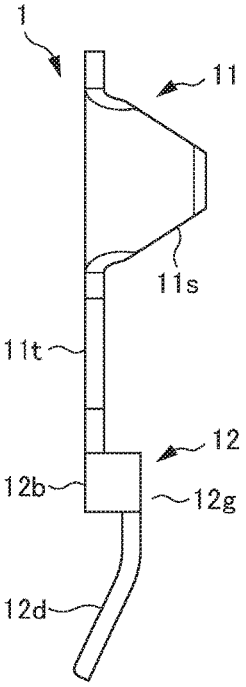
Figure 3B:
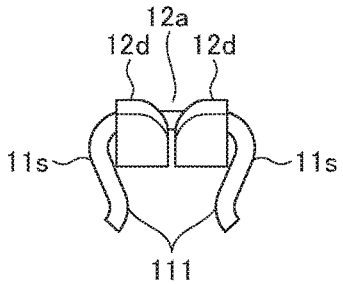

FIG. 3A to FIG. 3E are each views showing the constitution of the pressure contacting connection type contact according to the embodiment, and FIG. 3A is a plan view, FIG. 3B is a front face view, FIG. 3C is a right side face view, FIG. 3D is a back face view, and FIG. 3E is a lower face view.

Figure 4:
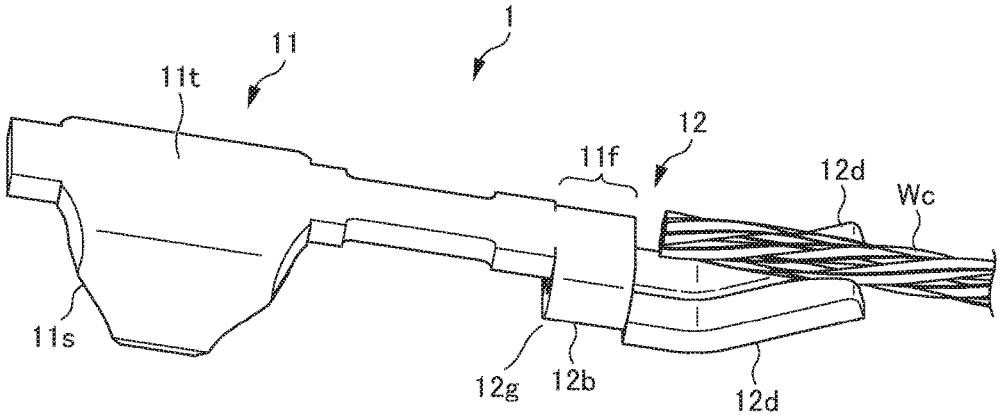
FIG. 4 is an oblique view showing the constitution of the pressure contacting connection type contact according to this embodiment, and shows a state wherein the central conductor is inserted into the pressure contacting terminal.

FIG. 4 is an oblique view showing the constitution of the pressure contacting connection type contact according to this embodiment, and shows a state wherein the central conductor is inserted into the pressure contacting terminal.

Figure 5A:
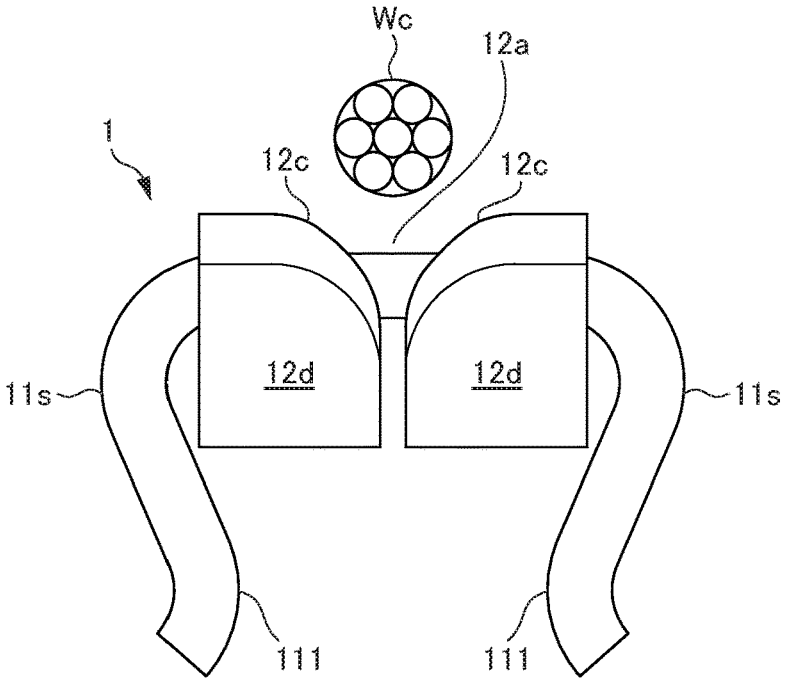
FIG. 5A and FIG. SB are enlarged front face views of the pressure contacting connection type contact of the embodiment.
Figure 5B:
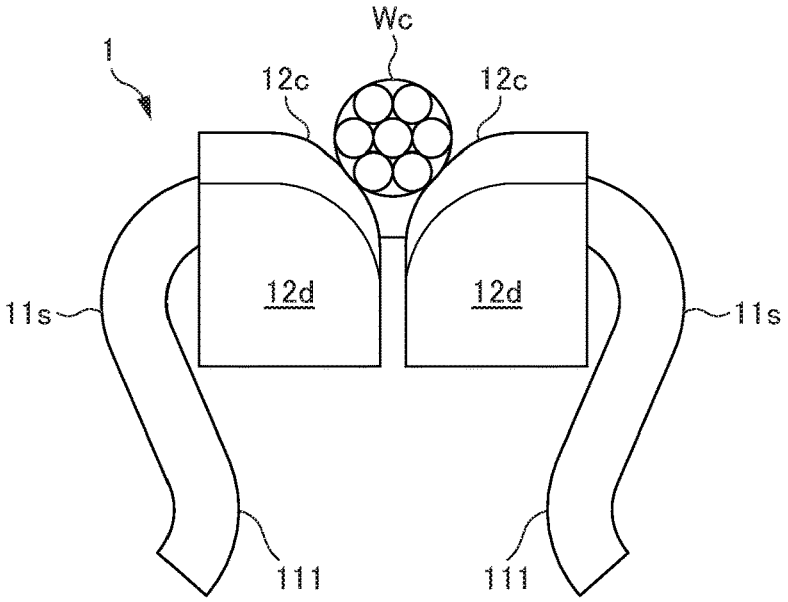
FIG. 5B shows a state where the central conductor is inserted at the tip portion side of the pair of pressure contacting pieces.

FIG. 5A and FIG. 5B are enlarged front face views of the pressure contacting connection type contact of the embodiment, and FIG. 5A shows a state before the central conductor is inserted at the tip portion side of the pair of pressure contacting pieces, and FIG. 5B shows a state where the central conductor is inserted at the tip portion side of the pair of pressure contacting pieces.

With reference to FIG. 1 to FIG. 5A and FIG. 5B, the pressure contacting connection type contact (below abbreviated as contact) 1 according to one embodiment of the present invention can electrically connect a coaxial cable Cb with a mating side connector, not shown in the drawings. The contact 1 is provided with a connecting terminal 11 and a pressure contacting terminal 12, at a base portion 11*t* formed in a strip shape. At the connecting terminal 11, the mating side connector can be connected, and at the pressure contacting terminal 12, the central conductor Wb of the coaxial cable Cb can be connected.

The pair of contacting pieces 11*s*•11*s* of the connecting terminal 11 extends curvilinearly in a vertical direction from first both side portions lie of one end side of the base portion 11*t*, the with tip portion side opened in an Ω shape. In this way, the mating side connector, not shown in the drawings, can be inserted inside the pair of contacting pieces 11*s*•11*s*.

The pair of contacting pieces 11*s*•11*s* has a pair of contact points 111•111 disposed facing each other at the tip portions of the contacting pieces 11*s*•11*s*. The pair of contact points 111•111 can contact the perimeter of the mating side contact, not shewn in the figures.

The pressure contacting terminal 12 includes a base end section 12*g*, pressure contacting pieces 12*d*•12*d*, and an open angle portion 12*a*. The base end section 12*g* has a form, wherein an extending piece extending from second both side portions 11*f* of the other end side of the base portion 11*t* is folded such that mutual piece thickness faces are opposed, opposite the other end side of the base portion 11*t*. The pressure contacting pieces 12*d*•12*d*, have a form where, from, the base end section 12*g*, an extending piece extends away from the base portion 11*t* to the tip portion side such that the piece thickness faces are opposed and in addition, rises obliquely at an opposite side of the protrusion direction of the pair of contacting pieces 11*s*•11*s*. The open angle portion 12*a* is formed at the tip portion side of the pair of pressure contacting pieces 12*d*•12*d*, and has a form such that the central conductor Wc of the coaxial cable Cb can be inserted from an outer direction.

The open angle portion 12*a* of the pair of pressure contacting pieces 12*d*•12*d* herein is opened in a V shape where the opposed piece thickness faces of the extending piece constituting the pressure contacting pieces 12*d*•12*d* at the tip portion side. In this way, the central conductor Wc of the coaxial cable Cb can be inserted to the open angle portion 12*a* between the pair of pressure contacting pieces 12*d*•12*d* from an outer direction thereof (refer to FIG. 4 or FIG. 5B).

According to the above constitution, the contact 1 according to the present embodiment is provided with a connecting terminal 11 provided at one end side of the base portion 11*t* with a pair of contacting pieces 11*s*•11*s* whose tip portion side is opened. Further, the contact 1 according to the present embodiment is provided with a pressure contacting terminal 12 having a pair of pressure contacting pieces 12*d*•12*d* wherein an extending piece, disposed at an other end side of the base portion 11*t*, folded such that piece thickness faces are opposed, from the base end section 12*g* extends away from the base portion 11*t* to the tip portion side, and also rises obliquely at an opposite side of the protrusion direction of the pair of contacting pieces 11*s*•11*s*. The open angle portion 12*a* is constituted at the tips of the pressure contacting pieces 12*d*•12*d* such that the central conductor Wc of the coaxial cable Cb can be inserted from an outer direction. In this way, in a state wherein the central conductor Wc is inserted between the pair of pressure contacting pieces 12*d*•12*d* or into the open angle portion 12*a*, the pair of pressure contacting pieces 12*d*•12*d* have elasticity or spring characteristics and can hold the central conductor Wc, and therefore, it is possible to provide a pressure contacting connection type contact which is capable of suppressing the creep phenomenon.

Further, the contact 1 preferably consists of a metal plate having conductivity, and by stamp-processing the metal plate having conductivity, it is possible to obtain a pressure contacting connection type contact of the desired shape. The contact 1 preferably consists of a copper alloy, but is not limited to a copper alloy.

With reference to FIG. 1 to FIG. 4, the base end section 12*g* of the pressure contacting terminal 12 may have close contact bent portions 12*b*•12*b* where the extending piece folded in the same direction as the protrusion direction of the pair of contacting pieces 11*s*•11*s* is bent to closely contact so as to be approach and oppose the base portion 11*t*. In this way, it is possible to further strengthen the strength of the base end section 12*g* of the pair of contact pressure contacting pieces 12*d*•12*d*. Such a constitution can be produced by fold processing an expansion metal plate having conductivity.

More specifically, the base end section 12*g* and the pair of pressure contacting pieces 12*d*•12*d* of the pressure contacting terminal 12 are constituted by fold processing a symmetrically shaped L shaped extending piece extending from second both side portions 11 of the other end side of the strip shaped base portion 11*t*. Namely, in the L shaped extending piece, the piece thickness faces of the extending piece of a parallel portion to the lengthwise direction of the strip shaped base portion 11*t* are folded to be opposed, and the base end section 12*g* and the pair of pressure contacting pieces 12*d*•12*d* are formed. Further, the tip portions of the pair of pressure contacting pieces 12*d*•12*d* rising obliquely from the base end section 12*g* are positioned to be somewhat higher than the horizontal level of the base portion 11*t* (refer to FIG. 3B, and FIG. 3C).

Further, with reference to FIG. 1 to FIG. 5A and FIG. 5B, the open angle portion 12*a* of the pair of pressure contacting pieces 12*d*•12*d* has a chamfered portion 12*c*•12*c* there the tip portion sides of the opposing piece thickness faces are chamfered in an arc shape. In this way, the central conductor Wc can be smoothly inserted between the pair of pressure contacting pieces 12*d*•12*d* or the open angle portion 12*a*.

Constitution of the Coaxial Connector

Figure 6:
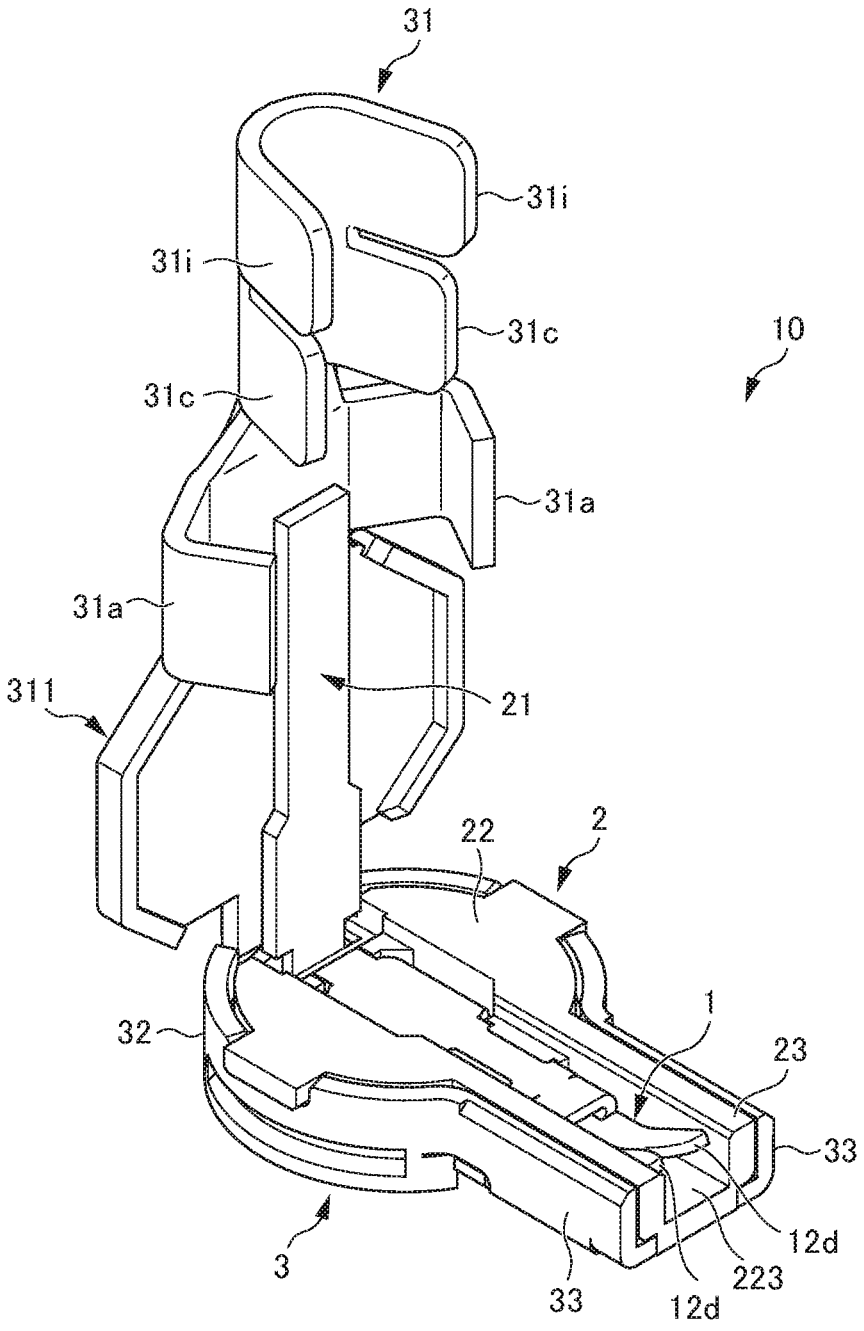
FIG. 6 is an oblique view showing the constitution of a coaxial connector according to one embodiment of the present invention, and shows a state before integrating the terminal of the coaxial cable with the coaxial connector.

Next, the constitution of the coaxial connector according to one embodiment of the present invention is explained. FIG. 6 is an oblique view showing the constitution of the coaxial connector according to one embodiment of the present invention, and shows a state before the terminal of the coaxial cable is installed in the coaxial connector.

Figure 7:
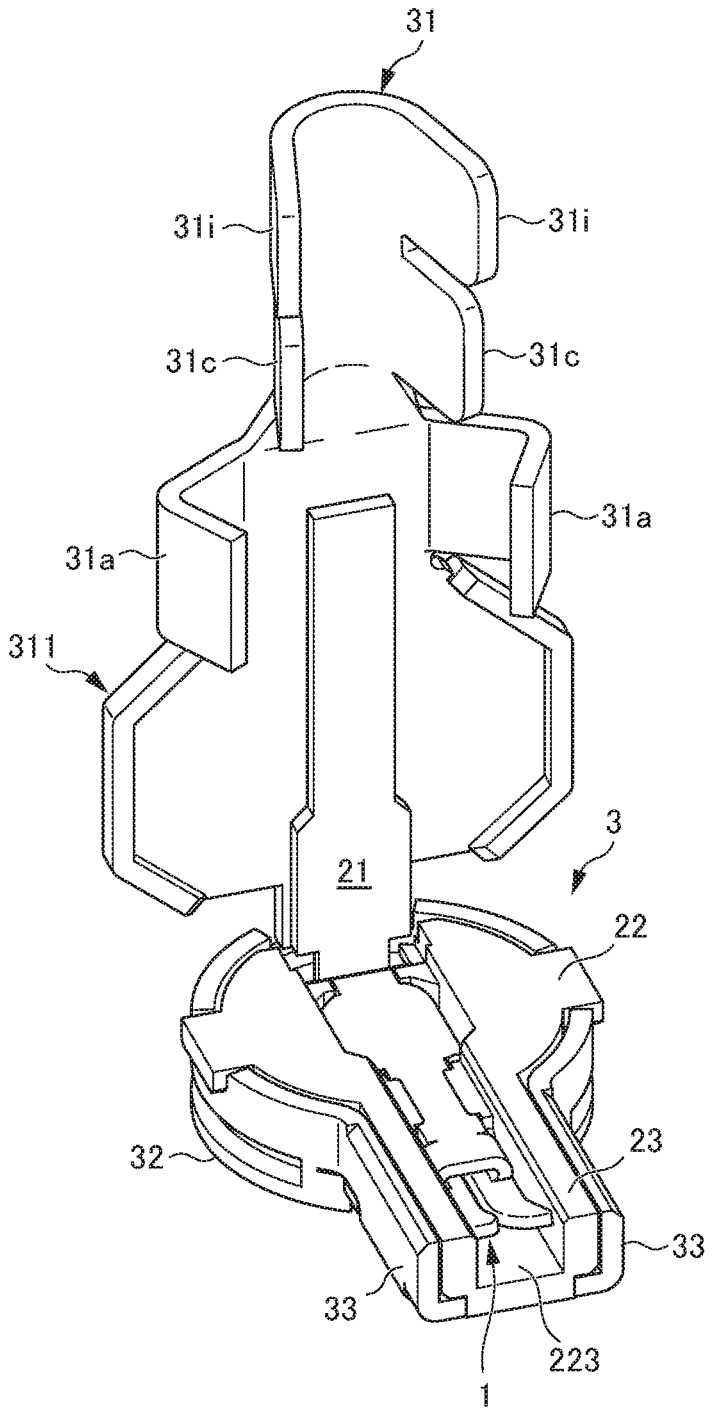
FIG. 7 is an oblique view showing the constitution of the coaxial connector according to this embodiment, and shows a state before integrating the terminal of the coaxial cable with the coaxial connector, viewed from a different direction than FIG. 6.

FIG. 7 is an oblique view showing the constitution of the coaxial connector according to this embodiment, and shows a state before the terminal of the coaxial cable is installed in the coaxial connector, viewed from a different direction than FIG. 6.

Figure 8:
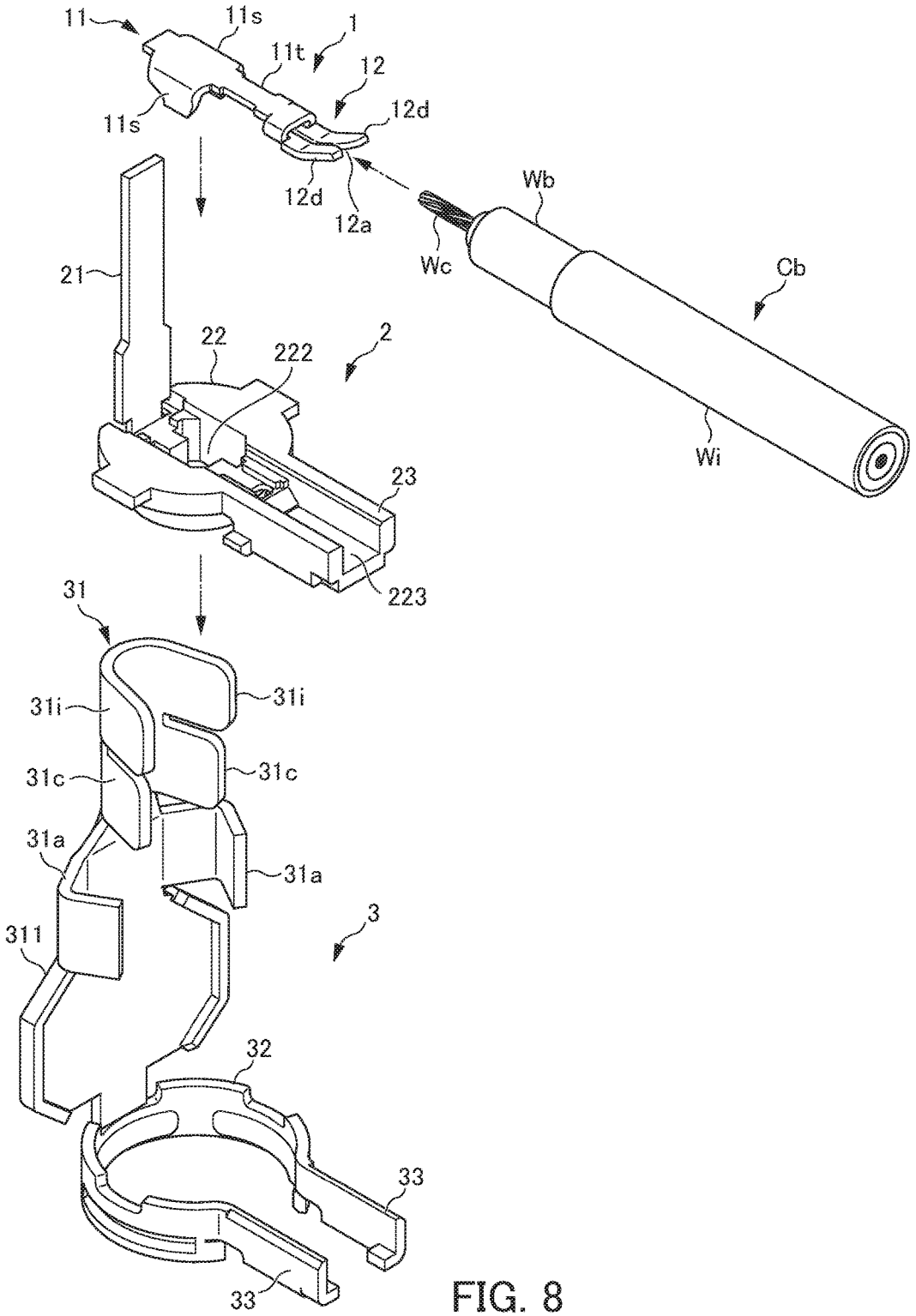
FIG. 8 is an oblique exploded view showing the constitution of the pressure contacting connection type contact according to the embodiment.
Figure 9D:
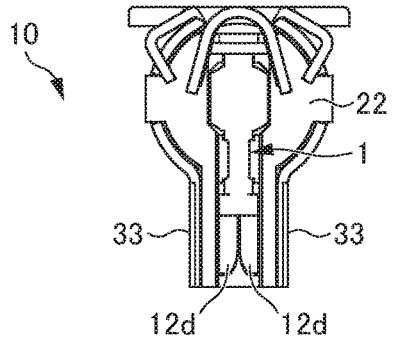
FIG. 9A to FIG. 9E are each views showing the constitution of the coaxial connector according to the embodiment.
Figure 9E:
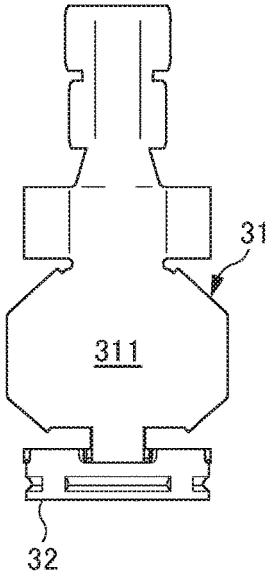
Figure 9A:
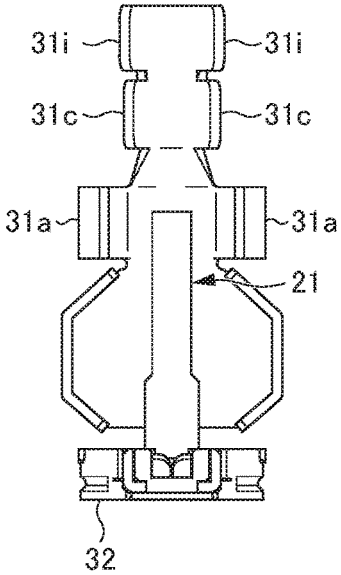
Figure 9C:
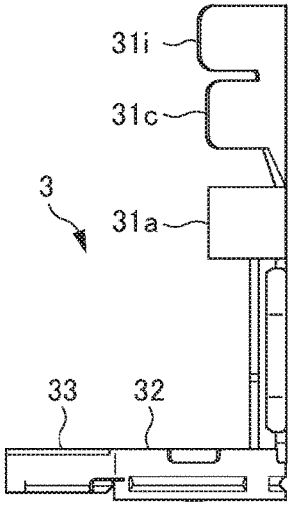
Figure 9B:
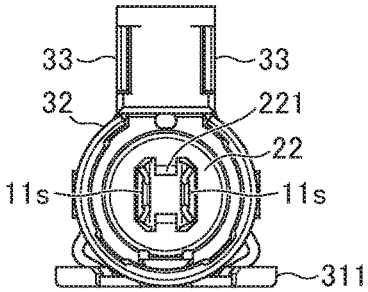

FIG. 8 is an oblique exploded view showing the constitution of the coaxial connector according to the embodiment. FIG. 9A to FIG. 9E are each views showing the constitution of the coaxial connector according to the embodiment, and FIG. 9A is a plan view, FIG. 9B is a front face view, FIG. 9C is a right side face view, FIG. 9D is a back face view, and FIG. 9E is a lower face view.

Figure 10:
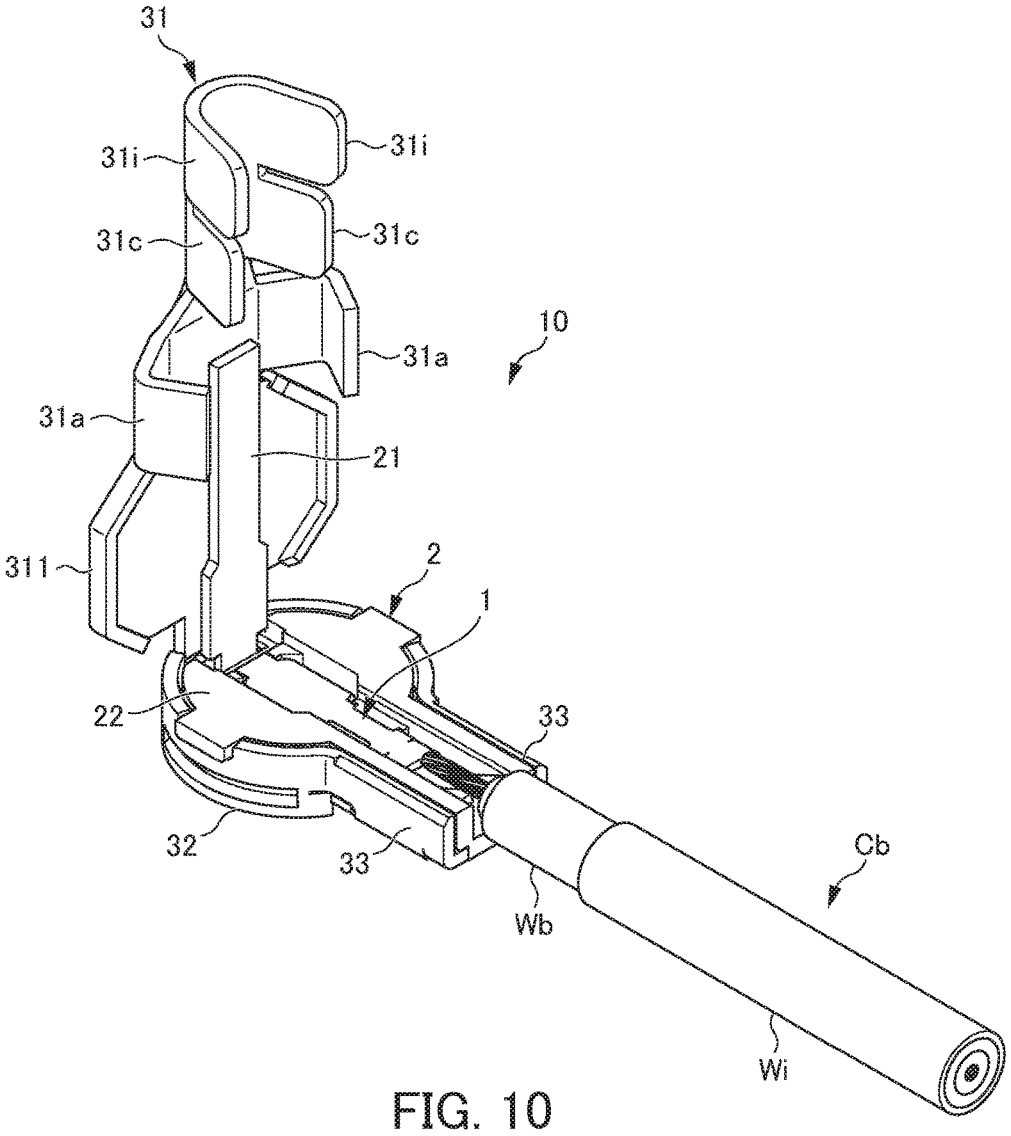
FIG. 10 is an oblique view showing the constitution of the coaxial connector according to this embodiment, and shows a state wherein the terminal of the coaxial cable has been inserted into the housing.

FIG. 10 is an oblique view showing the constitution of the coaxial connector according to this embodiment, and shows a state wherein the terminal of the coaxial cable has been inserted into the housing.

Figure 11:
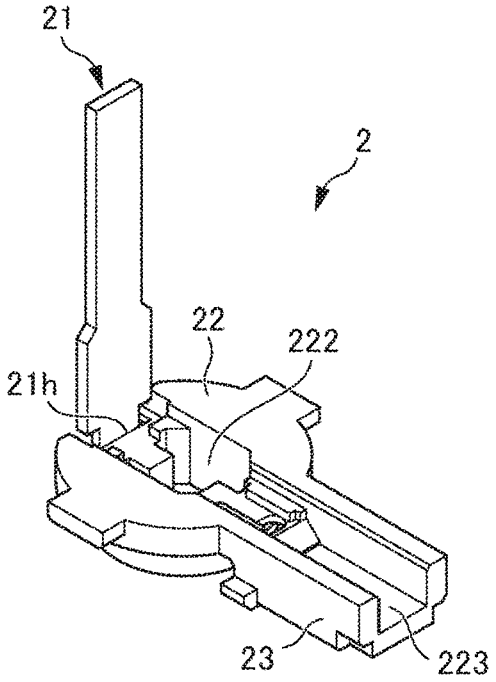
FIG. 11 is an oblique view showing the constitution of the housing provided at the coaxial connector according to this embodiment.

FIG 11 is an oblique view showing the constitution of the housing provided at the coaxial connector according to this embodiment.

Figure 12D:
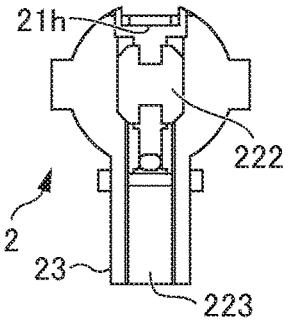
FIG. 12A to FIG. 12E are each views showing the constitution of the housing provided at the coaxial connector according to this embodiment.
Figure 12E:
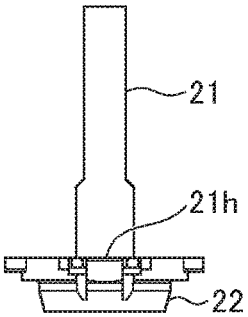
Figure 12A:
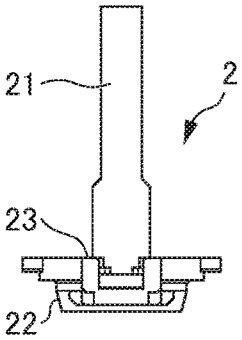
Figure 12C:
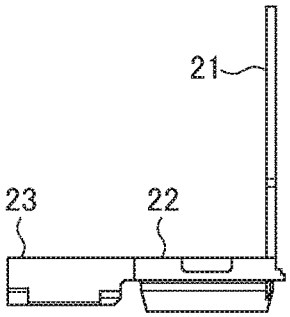
Figure 12B:
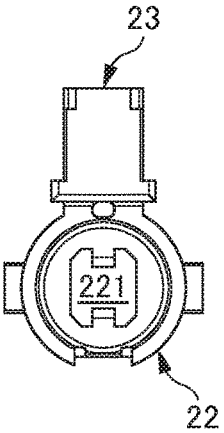
Figure 13:
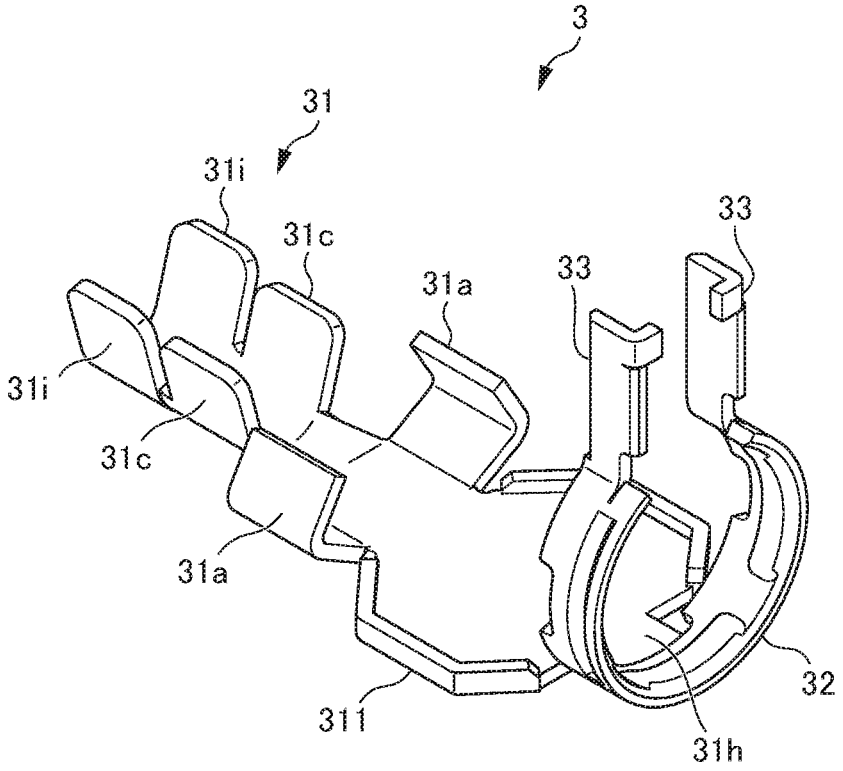
FIG. 13 is an oblique view showing the constitution of the shell provided with the coaxial connector according to this embodiment.

FIGS. 12A to 12E are each views showing the constitution of the housing provided at the coaxial connector according to this embodiment, and FIG. 12A is a plan view, FIG. 12B is a front face view, FIG. 12C is a right side face view, FIG. 12D is a back face view, and FIG. 12E is a lower face view, FIG. 13 is an oblique view showing the constitution of the shell provided at the coaxial connector according to this embodiment.

Figure 14D:
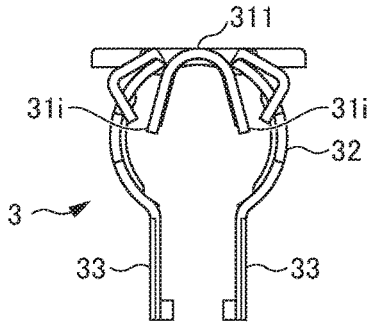
FIG. 14A to FIG. 14E are each views showing the constitution of the shell provided with the coaxial connector according to this embodiment.
Figure 14E:
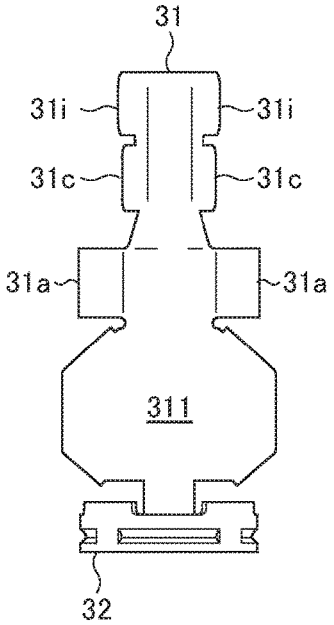
Figure 14A:
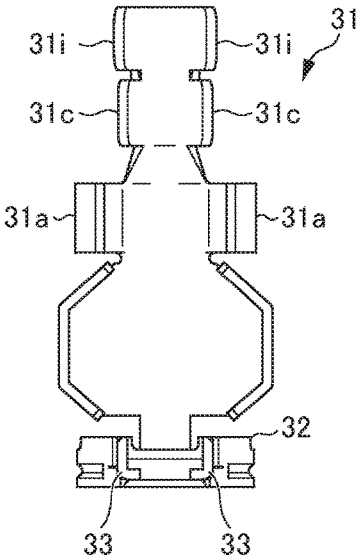
Figure 14C:
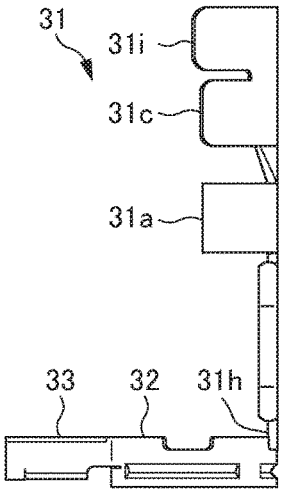
Figure 14B:
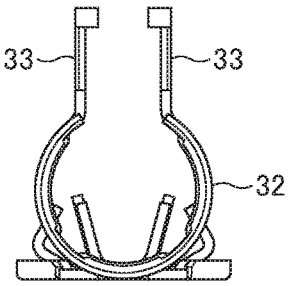

FIG. 14A to 14E are each views showing the constitution of the shell provided at the coaxial connector according to this embodiment, and FIG. 14A is a plan view, FIG. 14B is a front face view, FIG. 14C is a right side face view, FIG. 14D is a back face view, and FIG. 14E is a lower face view.

Figure 15A:
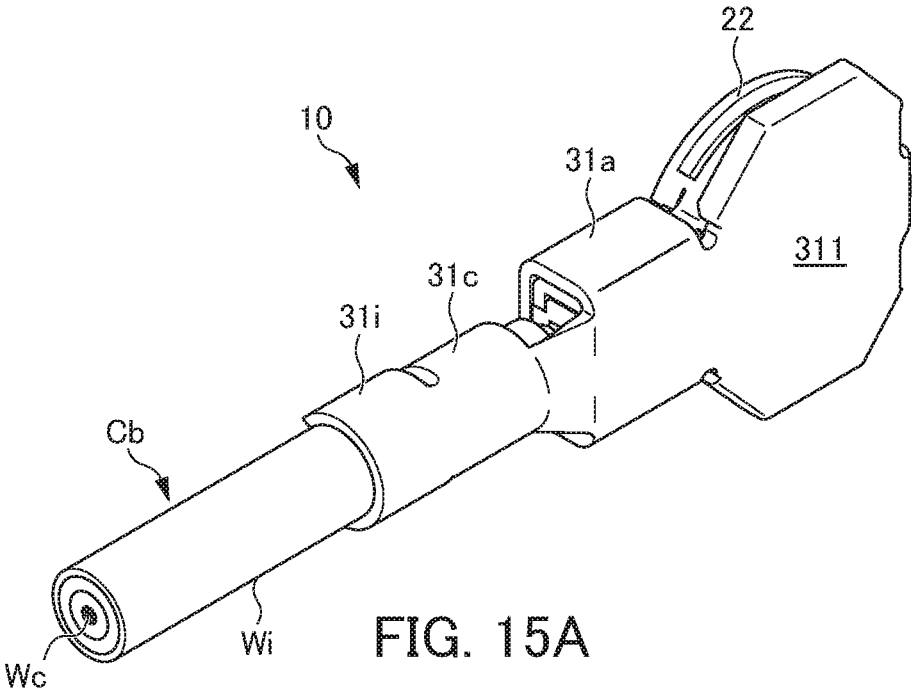
FIG. 15A and FIG. 15B are an oblique views showing the constitution of the coaxial connector according to the embodiment.
Figure 15B:
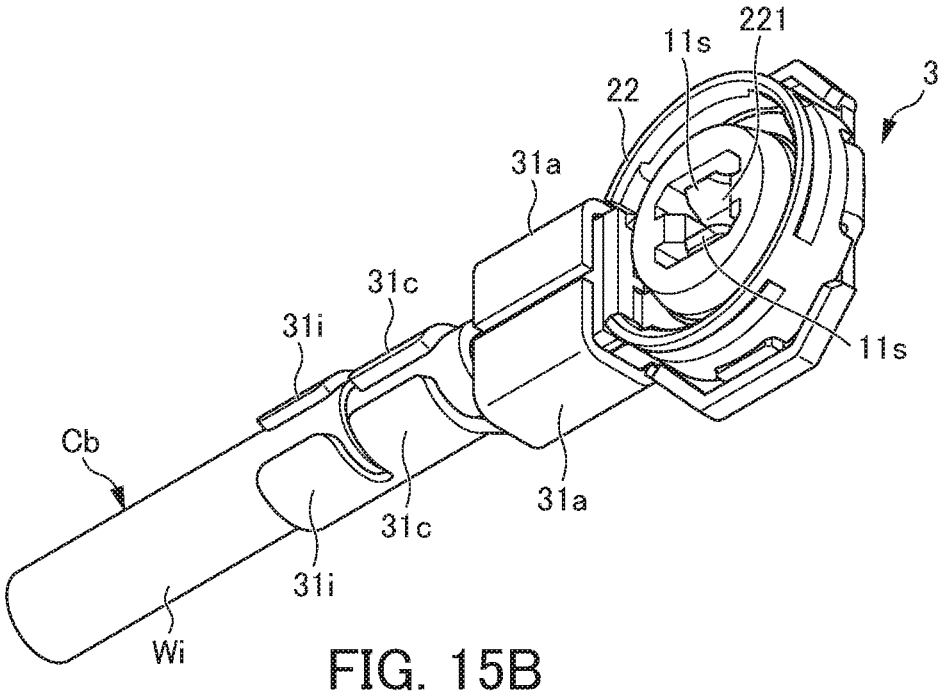

FIG. 15A and FIG. 15B are oblique views showing the constitution of the coaxial connector according to this embodiment, and FIG. 15A shows a state viewed from a front direction of a state where the cable clamp provided at the coaxial connector is folded, and FIG. 15B shows a state viewed from a rear direction of the state where the cable clamp provided at the coaxial connector is folded.

Overall Constitution

With reference to FIG. 1 to FIG. 15A and FIG. 15B, the coaxial connector 10 according to one embodiment of the present invention can constitute a terminal of the coaxial cable Cb. The coaxial connector 10 is provided with a contact 1, a compound housing 2, and an electrically conductive shell 3. The housing 2 has a strip shaped lid housing 21. The shell 3 has a cable clamp 31.

With reference to FIG. 11 or FIG. 12A to FIG. 12E, the housing 2 has a disk-shaped accommodating portion 22 and a rectangular-shaped accommodating portion 23. The rectangular-shaped accommodating portion 23 is provided projecting from one portion of the circumference of the disk-shaped accommodating portion 22. The disk-shaped accommodating portion 22 has a first accommodating chamber 221 in its central portion (refer to FIG. 9B or FIG. 15B).

With reference to FIG. 9B, the housing 2 has at one face, the first accommodating chamber 221 which is opened in a rectangular shape such that the mating connector, not shown in the figures, can be inserted. Moreover, the pair of contacting pieces 11*s*•11*s* are disposed inside the first accommodating chamber 221.

Further, with reference to FIG. 6 to FIG. 9A to FIG. 9E, the housing 2 has, at another face, a rectangularly opened second accommodating chamber 222. One portion of the second accommodating chamber 222 communicates with the first accommodating chamber 221. With reference to FIG. 8, the contact 1 can be inserted in the protruding direction of the pair of contacting pieces 11*s*•11*s* to the second accommodating chamber 222.

With reference to FIG. 11 or FIG. 12A to FIG. 12E, the rectangular-shaped accommodating portion 23 of the housing 2 has a groove portion 223 notched in a rectangular shape. The groove portion 223 communicates with the second accommodating chamber 222. The pair of pressure contacting pieces 12*d*•12*d* of the pressure contacting terminal 12 connecting with the central conductor Wb of the coaxial cable Cb can be inserted into the groove portion 223 (refer to FIG. 1 to FIG. 5A and FIG. 5B). Thus, the pair of pressure contacting pieces 12*d*•12*d* can be accommodated in the groove portion 223 (refer to FIG. 6 or FIG. 7).

With reference to FIG. 4 or FIG. 5B and FIG. 10, in a state wherein the central conductor Wc is inserted between the pair of pressure contacting pieces 12*d*•12*d* or into the open angle portion 12*a*, the piece thickness faces of the pair of pressure contacting pieces 12*d*•12*d* can contact the central conductor Wc from an outside direction, and therefore, it is possible to reliably electrically connect the central conductor Wc and the contact 1 in a state wherein the central conductor Wc is held.

With reference to FIG. 13 or FIG. 14A to FIG. 14E, the shell 3 has a cylindrical-shaped shell portion 32 and a pair of extended pieces 33•33. The cylindrical-shaped shell portion 32 can accommodate the disk-shaped accommodating portion 22 of the housing 2 from the same direction as the direction in which the pair of contacting pieces 11*s*•11*s* protrude, towards one face of the cylindrical-shaped shell portion 32 (refer to FIG. 6 to FIG. 8).

With reference to FIG. 13 or FIG. 14A to FIG. 14E, the pair of extended pieces 33•33 extends approximately parallel continuously from a portion of the outer periphery of the cylindrical-shaped shell portion 32. Thus, the rectangular-shaped accommodating portion 23 of the housing 2 can be accommodated inside the pair of extended pieces 33•33 (refer to FIG. 5 or FIG. 6).

With reference to FIG. 11 or FIG. 12A to FIG. 12E, one end of the lid housing 21 is foldably joined to a portion of the disk-shaped accommodating portion 22 by the hinge 21*h*, Further, the lid housing 21, at its other end side, can open and close the second accommodating chamber 222.

With reference to FIG. 13 or FIG. 14A to FIG. 14E, the cable clamp 31 has a base plate piece 311. One end portion of the base plate piece 311 is foldably joined to a portion of the cylindrical-shaped shell portion 32 by the hinge 31*h*. Further, the base plate piece 311, at another end side thereof, interlocks with the lid housing 21, and can open and close another face of the shell 3.

The cable clamp 31 comprises a pair of conductor barrels 31*c*•31*c* and a pair of insulation grips 31*i*•31*i*. The pair of conductor barrels 31*c*•31*c* can crimp the external conductor Wb (refer to FIG. 8 or FIG. 10). Thus, the pair of conductor barrels 31*c*•31*c* can electrically connect the external conductor Wb and the shell 3.

With reference to FIG. 8 or FIG. 15A and FIG. 15B, the pair of insulation grips 31*i*•31*i* can crimp the insulating sheath Wi. Thus, the pair of insulation grips 31*i*•31*i* can fix the coaxial connector 10 to the terminal of the coaxial cable Cb.

With reference to FIG. 13 or FIG. 14A to FIG. 14E, the cable clamp 31 further comprises a pair of crimp barrels 31*a*•31*a*, The pair of crimp barrels 31*a*•31*a* can crimp the rectangular-shaped accommodating portion 23 via the pair of extended pieces 33•33 (refer to FIG. 8 or FIG. 9A to FIG. 9E, FIG. 15A and FIG. 15B).

With reference to FIG. 4 or FIG. 5B, in a state wherein the central conductor Wc of the coaxial cable Cb is inserted between the pair of pressure contacting pieces 12*d*•12*d*, and the base plate piece 311 of the cable clamp 31 has closed the other face of the shell 3, it is possible to maintain the state wherein the plurality of pressure contacting pieces 12*d* contact the central conductor Wc.

According to the above constitution, the coaxial connector 10 is provided with a contact 1 constituted of a connecting terminal 11 provided, at one end side of the base portion 11*t*, with a pair of contacting pieces 11*s*•11*s* inside which the mating side connector, not shown in the drawings, can be inserted, and a pressure contacting terminal 12 having a pair of pressure contacting pieces 12*d*•12*d* where an extending piece, provided at an other end side of the base portion 11*t*, folded such that the piece thickness faces are opposed, extends from the base end section 12*g* away from the base portion 11*t* to the tip portion side such that the piece thickness faces are opposed, and also rises obliquely in an opposite direction to the protrusion direction of the pair of contacting pieces 11*s*•11*s*. At the tips of the pressure contacting pieces 12*d*•12*d*, an open angle portion 12*a* is constituted such that the central conductor Wc of the coaxial cable can be inserted from an outer direction. In this way, in a state in which the central conductor Wc is inserted between the pair of pressure contacting pieces 12*d*•12*d* or the open angle portion 12*a*, the pair of pressure contacting pieces 12*d*•12*d* have elasticity or spring characteristics and can hold the central conductor Wc, whereby it is possible to provide a coaxial connector 10 which can suppress the occurrence of the creep phenomenon.

Constitution of the Housing and Lid Housing

Next, the constitution of the housing 2 and the lid housing 21 according to the embodiment are explained. With reference to FIG. 11 or FIG. 12A to FIG. 12E, the housing 2 and the lid housing 21 preferably consist of a synthetic: resin having insulating properties, and by molding the synthetic resin having insulating properties, it is possible to obtain the housing 2 having the lid housing 21 in the desired shape.

With reference to FIG. 1 to FIG. 5A, FIG. 5B and FIG. 6 or FIG. 7, the base portion 11*t* can be mounted at a bottom face of the second accommodating chamber 222. With reference to FIG. 6 or FIG. 7, in a state wherein the base portion 11*t* is mounted at the bottom face of the second accommodating chamber 222, the pair of protruding pieces 11*p*•11*p* can position the contact 1 in the housing 2.

With reference to FIG. 6 or FIG. 7, by folding the lid housing 21 such that the lead housing 21 faces towards the bottom face of the groove portion 223 (refer to FIG. 15A and FIG. 15B), it is possible to maintain the state wherein the plurality of pressure contacting pieces 12*d*•12*d* contact the central conductor Wc.

Constitution of the Shell and the Cable Clamp

Next, the constitution of the shell 3 and the cable clamp 31 according to the embodiment are explained. With reference to FIG. 13 or FIG. 14A to FIG. 14E, for the shell 3 and the cable clamp 31, it is preferable to obtain a shell 3 provided with a cable clamp 31 of the desired shape by forming an expansion plate having conductivity by processing a metal plate having conductivity into a predetermined shape.

For the shell 3, an expansion plate having conductivity is preferably fold processed to form the cylindrical-shaped shell portion 32 and the pair of extended pieces 33•33. Further, at the cable clamp 31, the pair of conductor barrels 31*c*•31*c* and the pair of insulation grips 31*i*•31*i* are preferably formed by folding in an opened state. Further, the pair of crimp barrels 31*a*•31*a* are preferably formed by folding in a state disposed facing each other.

Operation of the Coaxial Connector

Next, the operation and effects of the coaxial connector 10 according to the present embodiment are explained, while explaining the assembly sequence of the coaxial connector 10 according to the embodiment.

First, with reference to FIG. 6 to FIG. 8, the contact 1 is inserted into the housing 2. Next, with reference to FIG. 8, the housing 2 including the contact 1 is inserted into the shell 3 from one face of the shell 3 (refer to FIG. 6 or FIG. 7). In this way, the shell 3 can hold the housing 2 including the contact 1.

Next, with reference to FIG. 8, the central conductor Wc of the coaxial cable Cb is accommodated in the groove portion 223, facing the groove portion 223 of the housing 2 (refer to FIG. 10). In this way, the pair of pressure contacting pieces 12*d*•12*d* can contact the central conductor Wc (refer to FIG. 4 or FIG. 5B). Next, as shown in FIG. 10, in a state wherein the cable clamp 31 is standing with respect to the shell 3, the cable clamp 31 is bent towards the other face of the shell 3 (refer to FIG. 15A and FIG. 15B).

Next, with reference to FIG. 15A and FIG. 15B, in a state wherein the base plate piece 311 of the cable clamp 31 has closed the other face of the shell 3, it is possible to maintain the state wherein the plurality of pressure contacting pieces 12*d* are pressure contacting the central conductor Wc. In this way, the contact 1 and the coaxial cable Cb can be reliably mechanically and electrically connected.

Next, with reference to FIG. 10 or FIG. 15A and FIG. 15B, the pair of crimp barrels 31*a*•31*a* crimp the rectangular-shaped accommodating portion 23 via the pair of extended pieces 33•33, whereby the pressure contacting state of the pressure contacting terminal 12 can be maintained. Next, with reference to FIG. 9A to FIG. 9E or FIG. 15A and FIG. 15B, the pair of conductor barrels 31*c*•31*c* crimp the external conductor Wb, whereby the external conductor Wb and the shell 3 can be electrically connected.

Next, with reference to FIG. 8 or FIG. 15A and FIG. 15B, the pair of insulation grips 31*i*•31*i* crimp the insulating sheath Wi whereby the terminal of the coaxial cable Cb can be fixed to the coaxial connector 10. Thus, the series of assembly operations is concluded.

With reference to each of FIG. 1 to FIG. 15A and FIG. 15B, the coaxial connector 10 is provided with a contact 1 constituted of a connecting terminal 11 having a pair of contacting pieces 11*s*•11*s* inside which the mating side contact, not shown in the figures, can be inserted, and a pressure contacting terminal 12 provided at an other end side of the base portion 11*t*, having a pair of pressure contacting pieces 12*d*•12*d* wherein an extending piece folded such that piece thickness faces are opposed extends from the base end section 12*g*, away from, the past portion 11*t* to a tip portion side such that the piece thickness faces are opposed and also rises obliquely at an opposite side of the protrusion direction of the pair of contacting pieces 11*s*•11*s*. The tips of the pressure contacting pieces 12*d*•12*d* are constituted with an open angle portion 12*a* where the central conductor Wc of the coaxial cable Cb can be inserted from an outer direction. In this way, in a state wherein the central conductor Wc is inserted between the pair of pressure contacting pieces 12*d*•12*d* or into the open angle portion 12*a*, the pair of pressure contacting pieces 12*d*•12*d* have elasticity or spring characteristics and can hold the central conductor Wc, and therefore, it is possible to provide a coaxial connector 10 which is capable of suppressing the creep phenomenon.

With reference to each view of FIG. 6 to FIG. 10, the cable clamp 31 comprises a pair of conductor barrels 31*c*•31*c* which can crimp the external conductor Wb, a pair of insulation grips 31*i*•31*i* which can crimp the insulating sheath Wi, and a pair of crimp barrels 31*a*•31*a* which can crimp the rectangular-shaped accommodating portion 23 via the pair of extended pieces 33•33, and therefore, the terminal of the coaxial cable Cb and the coaxial connector 10 can be reliably connected.

While preferred embodiments of the present invention have been described and illustrated above, it is to be understood that they are exemplary of the invention and are not to be considered to be limiting. Additions, omissions, substitutions, and other modifications can be made thereto without departing from the spirit or scope of the present invention. Accordingly, the invention is not to be considered to be limited by the foregoing description and is only limited by the scope of the appended claims.

What is claimed is:

1. A pressure contacting connection type contact for electrically connecting a coaxial cable and a mating side contact, comprising a connecting terminal having a base portion formed with a strip shape, and a pair of contacting pieces with a tip portion side opened in an Ω shape, inside which the mating side contact can be inserted, curvilinearly extending in a vertical direction from first both side portions of one end side of the base portion, and a pressure contacting terminal which pressure contacts a central conductor of the coaxial cable, at an other end side of the base portion wherein the pressure contacting terminal comprises a base end section opposing an other end side of the base portion, where an extending piece extending from second both side portions of the other end side of the base portion is folded such that mutual piece thickness faces are opposed, a pair of pressure contacting pieces wherein, from the base end section, the extending piece extends away from the base portion to a tip portion side such that the piece thickness faces are opposed, and also rises obliquely at an opposite side of a protrusion direction of the pair of contacting pieces, and an open angle portion of the opposed piece thickness faces of the extending piece, formed at the tip portion side of the pair of pressure contacting pieces, where the central conductor of the coaxial cable can be inserted from an outer direction.

2. The pressure contacting connection type contact according to claim 1, wherein the base end section of the pressure contacting terminal has a close contact bent portion which is bent to closely contact the base portion from the second both side portions, in a same direction as the protrusion direction of the pair of contacting pieces.

3. The pressure contacting connection type contact according to claim 1, wherein the open angle portion of the pair of pressure contacting pieces has a chamfered portion where tips portion sides of the opposed piece thickness faces are chamfered in an arc shape.

4. A coaxial connector constituting a terminal of a coaxial cable having a central conductor, an insulator surrounding this central conductor, an external conductor covering this insulator, and an insulating sheath covering this external conductor, comprising a pressure contacting connection type contact according to claim 1, a compound housing having a disk-shaped accommodating portion with one face opened such that a mating side contact is insertable, and having a first accommodating chamber inside which the connecting terminal of the pressure contacting connection type contact is disposed, and a rectangular-shaped accommodating portion protruding from one portion of an outer periphery of the disk-shaped portion, and having a second accommodating chamber one part of which communicates with the first accommodating chamber, and which in addition can accommodate the pressure contacting connection type contact inserted from a protrusion direction of the connecting terminal at another face, and wherein the rectangular-shaped accommodating portion has a groove portion which communicates with the second accommodating chamber and where the pressure contacting piece of the pressure contacting connection type contact is accommodated, and a conductive shell comprising a cylindrical-shaped shell portion which is capable of accommodating the disk-shaped accommodating portion from a same direction of as a direction of protrusion of the connecting terminal, towards one face, and a pair of extended pieces extending in an approximately parallel direction continuously from one part of an outer periphery of the cylindrical-shaped shell portion, wherein the rectangular-shaped accommodating portion can be accommodated.

5. A coaxial connector according to claim 4, wherein the housing comprises a strip shaped lid housing with one end side bendably joined with one portion of the disk-shaped accommodating portion, and an other end side being able to open and close the second accommodating chamber and the groove portion, and the shell comprises a cable clamp having a base plate piece with one end side bendably joined with one portion of the cylindrical-shaped shell portion, and an other end side which interlocks with the lid housing, and which can open and close an other face of the shell.

6. A coaxial connector according to claim 5, wherein the cable clamp comprises a pair of conductor barrels which can crimp the external conductor, a pair of insulation crimps which can crimp the insulating sheath, and a pair of crimp barrels which can crimp the rectangular-shaped accommodating portion via the pair of extended pieces.

* * * * *